US006766755B2

(12) United States Patent
Cipolla et al.

(10) Patent No.: US 6,766,755 B2
(45) Date of Patent: Jul. 27, 2004

(54) HYDRAULIC ACTIVATED SPREADER ARM APERTURE GENERATION SYSTEM

(75) Inventors: Kimberly M. Cipolla, Portsmouth, RI (US); David A. Hurdis, Narragansett, RI (US); Michael R. Williams, West Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 167 days.

(21) Appl. No.: 10/214,523

(22) Filed: Aug. 8, 2002

(65) Prior Publication Data

US 2004/0027920 A1 Feb. 12, 2004

(51) Int. Cl.[7] ..... B63B 21/66

(52) U.S. Cl. ..... 114/244; 114/243; 267/153; 267/154

(58) Field of Search ..... 114/242, 243, 114/244, 245; 367/153, 154

(56) References Cited

U.S. PATENT DOCUMENTS 3,019,412 A * 1/1962 Crawford ..... 367/173
4,970,046 A * 11/1990 Dolengowski ..... 367/153
4,970,696 A * 11/1990 Crews et al. ..... 367/15
6,694,909 B1 * 2/2004 Cipolla et al. ..... 114/242

* cited by examiner

*Primary Examiner*—Sherman Basinger
(74) *Attorney, Agent, or Firm*—James M. Kasischke; Michael F. Oglo; Jean-Paul A. Nasser

(57) ABSTRACT

A spreader arm aperture generation system for use with a towed array is provided. The spreader arm aperture generation system broadly comprises a plurality of lines and a plurality of hydraulically activated, inflatable tubes for generating horizontal and vertical separation among the lines. Each of the tubes is filled with seawater to a desired pressure to achieve the desired horizontal and vertical line separation. Preferably, each of the tubes is formed from a high strength woven fabric.

14 Claims, 2 Drawing Sheets

HYDRAULIC ACTIVATED SPREADER ARM APERTURE GENERATION SYSTEM

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

Not applicable.

BACKGROUND OF THE INVENTION (1) Field of the Invention

The present invention relates to a hydraulic activated spreader arm aperture generation system for generating a volumetric aperture for multiple line towed arrays.

(2) Description of the Prior Art

Present mobile sonar arrays include two and three dimensional hull mounted arrays and towed linear arrays. Many of the towed linear arrays have multiple lines. Such array systems are shown in U.S. Pat. No. 4,958,331 to Wardle, U.S. Pat. No. 4,970,696 to Crews et al., and U.S. Pat. No. 5,841,733 to Bouyoucos et al.

The problem in the design of multiple line towed arrays is to provide a means for reliably generating and maintaining separation of the lines in a specified three-dimensional configuration. Any system for aperture generation must be compatible with the method of deploying and retrieving the towed system. For current technology, this means that the aperture generation system has to collapse to a significantly reduced volume prior to retrieval.

Also, the aperture generation system must operate under the following constraints: (1) maintain separation distances across relevant operating speed ranges; (2) allow deployment and retrieval of the towed system and proper operation of the sensors; (3) survive flank speed of tow platform; (4) operate reliably in a seawater environment; (5) meet temperature range compliance and hydrostatic pressure compliance; (6) meet material compatibility; and (7) maintain performance for a minimum of three months without maintenance in a submarine environment.

SUMMARY OF THE INVENTION

Accordingly, it is an object of the present invention to provide a spreader arm aperture generation system which is compatible with current towed arrays.

It is a further object of the present invention to provide a spreader arm aperture generation system as above which is simple in design and less expensive to produce.

It is yet another object of the present invention to provide a spreader arm aperture generation system as above which has a negligible impact on array performance and/or self noise.

It is still another object of the present invention to provide a spreader arm aperture generation system as above which has increased compatibility with a marine environment.

Still further, it is an object of the present invention to provide a spreader arm aperture generation system as above which produces an aperture independent of the tow speed of a platform.

The foregoing objects are attained by the hydraulic activated spreader arm aperture generation system of the present invention.

In accordance with the present invention, a spreader arm aperture generation system for use with a towed array is provided. The spreader arm aperture generation system broadly comprises a plurality of tow lines, a sleeve affixed to each tow line and joinable with lines of the towed array, and hydraulically activated means positioned between at least two of the sleeves for generating horizontal and vertical separation among the lines. The hydraulically activated means in a preferred embodiment of the present invention are formed by a plurality of inflatable tubes, which tubes extend between sleeves affixed to the lines.

Other details of the hydraulic activated spreader arm aperture generation system of the present invention, as well as other objects and advantages attendant thereto, are set forth in the following detailed description and the accompanying drawings wherein like reference numerals depict like elements.

DESCRIPTION OF THE PREFERRED EMBODIMENT

Figure 1:
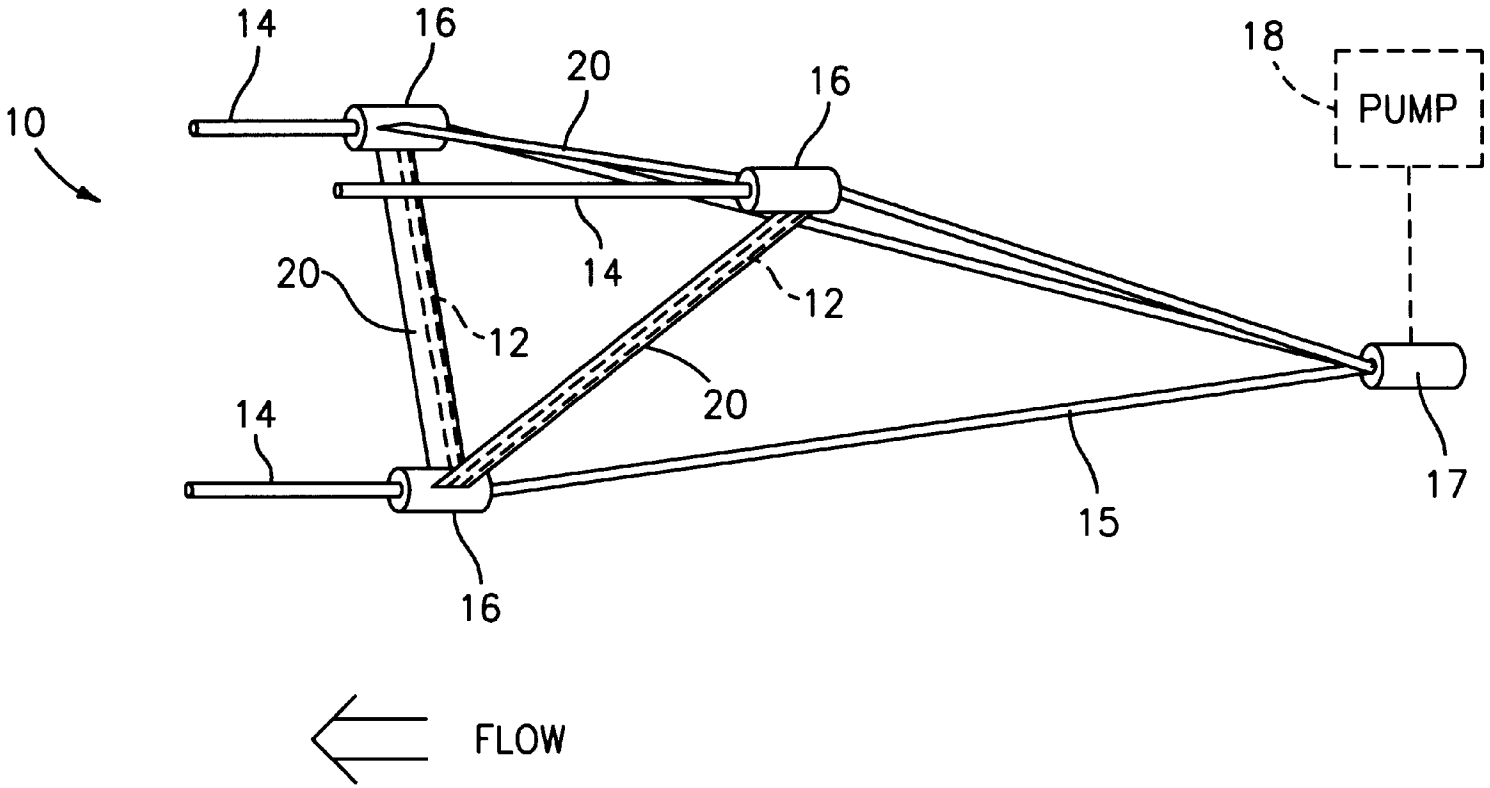
FIG. 1 is a schematic representation of a hydraulic activated spreader arm aperture generation system in accordance with the present invention.

Referring now to the drawings, FIG. 1 illustrates a hydraulic activated spreader arm aperture generation system 10 in accordance with the present invention designed for a three line towed system. The system 10 is designed to generate a volumetric aperture for the multiple line towed system.

The system 10 has a number of hollow tubes 12 constructed from a high strength woven fabric. The fabric may comprise any suitable high strength woven fabric known in the art. The tubes 12 are filled with seawater to a required inflation pressure and when filled function as rigid arms. The required inflation pressure is defined by the desired volumetric configuration and operational speed range.

The individual array lines 14 of the multiple line system have sleeves 16 incorporated therein. The sleeves 16 are attached together by the tubes 12. A plurality of tow lines 15 may be connected to the sleeves 16 using any suitable means known in the art. The forward end of the tow lines 15 can come together at a forward module 17. The sleeves 16 do not interfere with the acoustic operation of the towed system and may be designed for quick disconnect for maintenance and replacement.

If desired, one or more of the array lines 14 may be ballasted by placing ballast in a respective sleeve 16. The ballast when used helps to maintain the position of one or more desired array lines 14 below other array lines 14. Placing ballast in a sleeve 16 also minimizes the rotation of the entire configuration.

Inflation of the tubes 12 with seawater is accomplished through an active pumping mechanism 18 which is active only during the initial inflation and therefore does not affect towed system acoustic performance. The pump mechanism 18 can be located in or in communication with forward module 17. Seawater is pumped by the pump mechanism 18 and through at least one tow line 15 to at least one sleeve 16. Within sleeve 16, tube 12 is joined to receive the pumped seawater. Once the tubes 12 have been filled with seawater to the desired inflation pressure, a desired horizontal and vertical separation among the lines 14 is achieved. Prior to system storage, the tubes 12 may be deflated so that they collapse to a suitably small volume. The flexible tubing used for the tubes 12 is conducive to handling.

Figure 2A:
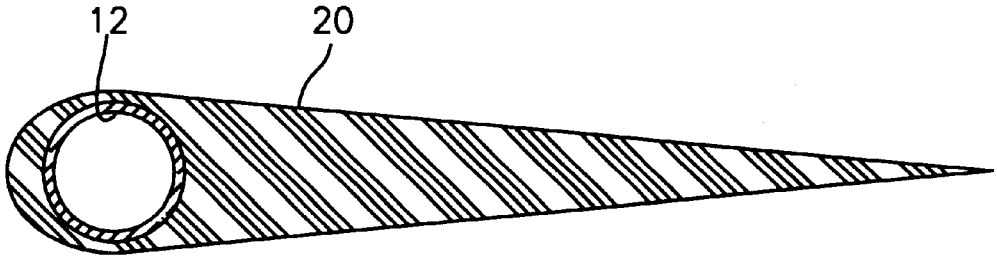
FIGS. 2(*a*)–2(*c*) illustrate cross-sectional shapes for an external sheath used in the system of FIG. 1.
Figure 2B:
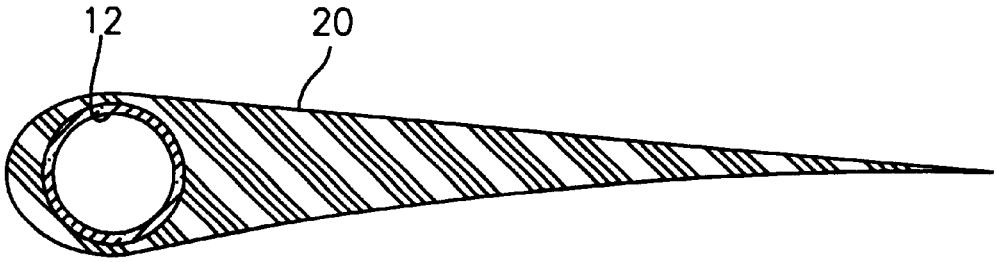
Figure 2C:
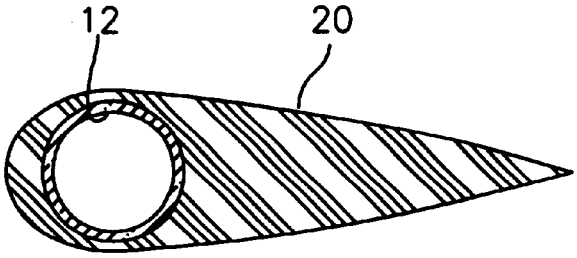

The load bearing portion of each tube 12 is preferably circular in cross section as shown in FIGS. 2(*a*)–2(*c*) to maximize structural rigidity. A circular shape is desirable because it ensures uniform inflation pressure throughout the respective tube 12. While it is preferred that the tubes 12 have a circular cross sectional shape, the tubes 12 could have other cross sectional shapes if desired.

External sheaths 20 may be placed over the load bearing tubes 12. The cross sectional shape of each sheath 20 may be designed to minimize drag and optimize the functionality of the system 10. Specifically, the shape may be used to augment the separation where desired and can vary along the length of the tubes 12. Several possible cross sectional shapes are shown in FIGS. 2(*a*)–2(*c*). The sheath 20 may be coated to minimize the skin friction coefficient and marine growth to improve compatibility with the seawater environment. Any suitable coating material known in the art which reduces skin friction coefficient and marine growth may be applied to each sheath 20.

The system 10 provides a number of advantages over other methods or designs. These include simplicity of design, cost reduction, compatibility with towed system envelope, minimal noise, minimal variation in aperture, and improved environmental compatibility. The generation system of the present invention substantially decreases the number of parts and complexity when compared to the current aperture generation system. The generation system employs new high strength, flexible materials, and advanced manufacturing techniques. The generation system of the present invention is designed to be compatible with the specifications for current towed array operations and survival and therefore can be implemented in existing multiple line towed systems. Also the geometry of the system of the present invention is such that it has no impact on current towed array storage tube or handling systems. The generation system of the present invention is constructed from a fabric type of material and thus has negligible impact on the array performance or self-noise. The generation system of the present invention produces an aperture independent of the tow speed of the platform. In contrast, the aperture of current multiple towed line systems that rely on lifting surfaces can vary up to 50% over the operating speed range. The generation system of the present invention contains few or no metal components, thereby significantly increasing compatibility with the marine environment. Current systems rely heavily on high precision metal parts and interfaces that are susceptible to marine growth and deposits.

While the spreader arm aperture generation system of the present invention has been described in the context of a three line towed system, it should be recognized that the generation system may be adapted for systems having more than three array lines.

It is apparent that there has been provided in accordance with the present invention a hydraulic activated spreader arm aperture generation system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An aperture generation system for use with a towed array comprising:

a plurality of tow lines;

a sleeve affixed to each tow line and joinable with lines of the towed array;

hydraulically activated means positioned between at least two of said sleeves for generating horizontal and vertical separation among said lines.

2. The device according to claim 1, wherein said hydraulically activated means comprises a plurality of inflatable tubes extending between said sleeves.

3. The device according to claim 2, wherein each of said tubes is formed from a high strength woven fabric.

4. The device according to claim 2, further comprising an external sheath placed over each said tube.

5. The device according to claim 4, wherein each said external sheath is coated to minimize skin friction coefficient and marine growth.

6. The device according to claim 2, further comprising means for filling each said tube with seawater to a required inflation pressure.

7. The device according to claim 6, wherein said filling means comprises an active pumping mechanism.

8. The device according to claim 2, wherein at least one of said sleeves is ballasted to maintain the position of at least one tow line below at least one other tow line.

9. The device according to claim 2, wherein each said tube has a circular cross sectional shape.

10. A spreader for a towed array having multiple array lines comprising:

a plurality of tow lines;

a sleeve positioned at the end of each said tow line, each array line being extendable from one sleeve; and an inflatable tube joined between two sleeves.

11. The device of claim 10, further comprising a forward module joined at the forward end of said plurality of tow lines.

12. The device of claim 11, further comprising a pump in hydraulic communication with said forward module to provide pressurized seawater thereto, at least one of said plurality of tow lines being in hydraulic communication with said forward module, and said inflatable tube being in hydraulic communication with said at least one tow line.

13. The device of claim 12, further comprising a hydrodynamic sheath positioned on said inflatable tube to give said inflatable tube a hydrodynamic shape.

14. The device of claim 10, further comprising:

a hydrodynamic sheath positioned on said inflatable tube to give said inflatable tube a hydrodynamic shape;

a forward module joined at the forward end of said plurality of tow lines; and a pump in hydraulic communication with said forward module for providing pressurized seawater thereto, at least one of said plurality of tow lines being in hydraulic communication with said forward module, and said inflatable tube being in hydraulic communication with said at least one tow line.

* * * * *